US005928068A

United States Patent [19]

Matsuda et al.

[11] Patent Number: 5,928,068

[45] Date of Patent: Jul. 27, 1999

[54] SUPERFINISHING APPARATUS USING FILM ABRASIVE

[75] Inventors: Hiroshi Matsuda; Masazumi Fujihara, both of Kawanishi, Japan

[73] Assignee: Matsuda Seiki Co., Ltd., Kawanishi, Japan

[21] Appl. No.: 08/931,264

[22] Filed: Sep. 16, 1997

[30] Foreign Application Priority Data

Jul. 10, 1997 [JP] Japan ..... 9-202298

[51] Int. Cl.[6] ..... B24B 21/00

[52] U.S. Cl. ..... 451/296; 451/299; 451/303; 451/304; 451/438

[58] Field of Search ..... 451/296, 299, 451/303, 304, 310, 59, 438

[56] References Cited

U.S. PATENT DOCUMENTS 2,932,926 4/1960 Dreiling .
3,619,949 11/1971 Welsch et al. .
4,091,573 5/1978 Schmidt .
5,148,639 9/1992 Sakai et al. ..... 451/304
5,245,792 9/1993 Liechti et al. ..... 451/11
5,361,546 11/1994 Jonsson ..... 451/310

*Primary Examiner*—Eileen P. Morgan
*Attorney, Agent, or Firm*—Wenderoth, Lind & Ponack, L.L.P.

[57] ABSTRACT

A superfinishing apparatus has an abrasive film feed mechanism for feeding out and winding up an abrasive film (4). The apparatus includes a backup roll (2) for pressing and vibrating the film against a workpiece. A guide member (3) is provided for the film feed mechanism immediately before the backup roll (2). The guide member has two pairs of helical grooves (11, 12) and (13, 14) arranged opposite in turning direction to each other. The helical grooves are different in radius from the center from each other and are provided on both side faces of the guide member. Also, when the film has passed through the helical grooves (11 and 13 or 12 and 14), its traveling path is translated transversely of the guide member.

6 Claims, 8 Drawing Sheets

SUPERFINISHING APPARATUS USING FILM ABRASIVE

BACKGROUND OF THE INVENTION

The present invention relates to a superfinishing apparatus using an abrasive film and, in particular, to an apparatus for superfinishing small or fine objects that are difficult to grind such as mechanical parts having a complex configuration.

FIG. 7 shows an example of a conventional superfinishing apparatus using an abrasive film 4 in the form of an elongated tape. The film 4, which is successively fed out from a feed spool 21 by wind-up force of a wind-up spool 22, is led to a backup roll 2 by a guide roll 23. Then, the film 4 is pressed at its grinding surface against a workpiece 24 by the backup roll 2 and, through axial vibrations applied to the backup roll 2, the film grinds the surface of the workpiece 24 to achieve superfinishing thereon. After the grinding, the film 4 is wound up around the wind-up spool 22 via a guide roll 25.

The film 4 is introduced necessarily vertically with respect to the axis of the backup roll 2. Therefore, depending on the shape of the workpiece 24, it would, in some cases, be difficult or impossible to grind the workpiece with ordinary superfinishing apparatuses.

For example, in the case of a T-shaped gear 26 shown in FIG. 8(A), which is a part used for differential gears or the like relating to the power transmissions of automobiles, attempting to grind even the root of the shaft in the process of grinding the gear teeth would cause the film feed mechanism 27 to make contact with the shaft. Also, attempting to grind even the root portion of the shaft in the process of grinding the shaft as shown in FIG. 8(B) would likewise cause the film feed mechanism 27 to make contact with the gear teeth, such that there would occur a portion of a distance d from the corner portions that cannot be ground.

Furthermore, in grinding an article having a complex configuration such as a crank 28 shown in FIG. 8(C), since the film feed mechanism 27 makes contact more often with portions other than the grinding surface of the crank 28, it would be difficult to grind small or fine portions of the crank 28.

Interference between the article and the film feed mechanism 27 occurs to one side surface of the film 4. Therefore, if the film 4 can be slid transversely and moved as it is until the time immediately before being introduced to the backup roll 2, then the film feed mechanism 27 can be prevented from making contact with the article on a side opposite to the side toward which the film 4 has been slid.

In order to slide the traveling path of the film 4, there arises a need for a device which can change the traveling direction of the film. One solution is a method of changing the traveling direction of the film 4 by winding the rear surface (the surface that is not used for grinding) of the film 4 around the surface of a cylindrical member 29, as shown in FIG. 9.

In this case, if the inclination (lead angle) of the center axis of the cylindrical member 29 with respect to the original traveling direction of the film 4 is assumed as $\Theta$ (rad), and if the film 4 is wound around the surface of the cylindrical member 29 at an angle of $2\pi$ (rad), i.e., 180°, then the traveling direction of the film 4 is changed by an angle of $2\Theta$ (rad). It is noted that the changing angle $2\Theta$ is not affected by the size of the cylindrical member 29.

If two cylindrical members 29 are provided, the forward and backward traveling directions of the film 4 can be changed with respect to the backup roll.

Further, if the traveling direction of the film 4, which has once been changed, is re-changed to the same direction as the original traveling direction by winding the film 4 around another cylindrical member 29 at the same lead angle $\Theta$, then the traveling direction of the film 4 can be translated transversely.

If the traveling direction of the film 4 can be translated transversely as described above, then the film feed mechanism 27 will not interfere with the parts shown in FIG. 8, and thus the grinding work up to end portions is possible.

Furthermore, since the feed direction of the film 4 and the axial direction of the backup roll 2 will not vary, most of the conventional grinding apparatuses and equipment therefor can be utilized.

However, using a plurality of cylindrical members 29 for changing the traveling direction of the film abrasive would cause the mechanism to become more complex, which results in increased costs.

Also, it is possible that the member for changing the traveling direction of the film abrasive may itself interfer with the article to be ground or that a change of the traveling direction hinders the abrasive film from smoothly traveling, contrary to what is expected.

SUMMARY OF THE INVENTION

The present invention has been developed to solve these and other problems. An object of the invention is therefore to provide a superfinishing apparatus which can achieve superfinishing of small or fine portions on parts having configurations which would conventionally be difficult to grind due to interference with the film feed mechanism.

To achieve the above object, the present invention provides a superfinishing apparatus including a film abrasive feed mechanism for feeding out and winding up a film abrasive, and a backup roll for pressing and vibrating the film abrasive against a portion of an object to be ground. The apparatus includes a guide member which is provided immediately before the backup roll, and two helical grooves arranged opposite in turning direction to each other and different in radius from the center from each other. The grooves are provided on both side faces of the guide member, and when the film abrasive has passed through the helical grooves, its path of travel has been translated transversely.

In this invention, two helical grooves are provided on each of two side faces of one guide member to guide the forward and backward travel of the film abrasive.

Each of these helical grooves has a groove width which is generally equal to or slightly larger than the width of the film abrasive. The bottom surface of the groove is a smooth surface, and functions to guide the film abrasive while keeping the bottom surface, i.e. the surface that is not used for grinding, in contact with the rear surface of the film abrasive.

The bottom surface of each helical groove supplies the function of the surface of the cylindrical member shown in FIG. 9. The arrangement of the two helical grooves provided on each of both side faces of the guide member is equivalent to a total of four cylinders.

In this case, the two helical grooves provided on each side face of the guide member differ in the turning direction of their helices as well as in the distance from their center axes, i.e., the turning radius of the helices. As a result, at a portion where the two helical grooves cross each other, one helical groove which is smaller in radius from the center (deep groove) disrupts halfway the other helical groove which is larger in radius from the center (shallow groove).

At the portion where the two helical grooves cross each other, one abrasive film, which has passed through the shallow groove, passes in the air, thus crossing in two levels with another abrasive film that passes under through the deep groove.

If the helical axis of a helical groove is set to an angle of e with respect to the original traveling direction of the film, and if the helical groove is formed at a turning angle of 180° at each side face of the guide member, then the feed direction of the abrasive film will change by an angle of 2⊖ according to the principle shown in FIG. 9.

Further, the abrasive film wound 180° around the helical groove on the other side face of the guide member will travel toward the original direction in such a form just as if it was wound around one cylinder to one turn of 360°. Thus, the new traveling path is translated transversely from the original traveling path.

If the lead angle ⊖ is $\pi/2$, i.e., 45°, the traveling direction of the abrasive film changes to 2⊖, i.e., a right angle, due to the helical groove on one side face of the guide member, and the abrasive film further changes in its traveling direction to a right angle by the helical groove on the other side face to which the abrasive film has been led by a linear groove, thus returning to the original direction.

In addition, in the guide member, the lead angle ⊖ may be changed, as required, within a range of about 45°, for example, from 30° to 60°. By appropriately selecting the angle ⊖ and the distance between the two side faces, the amount of transverse shift of the traveling path of the film abrasive can be adjusted.

BRIEF DESCRIPTION OF THE DRAWINGS

FIG. 3(A) is a front view and FIG. 3(B) is a right side view;

FIG. 4(A) is a plan view, FIG. 4(B) is a left side view and FIG. 4(C) is a bottom view;

FIG. 8(C) is a front view in which a crank is ground.

DETAILED DESCRIPTION OF THE PREFERRED EMBODIMENTS

Figure 1:
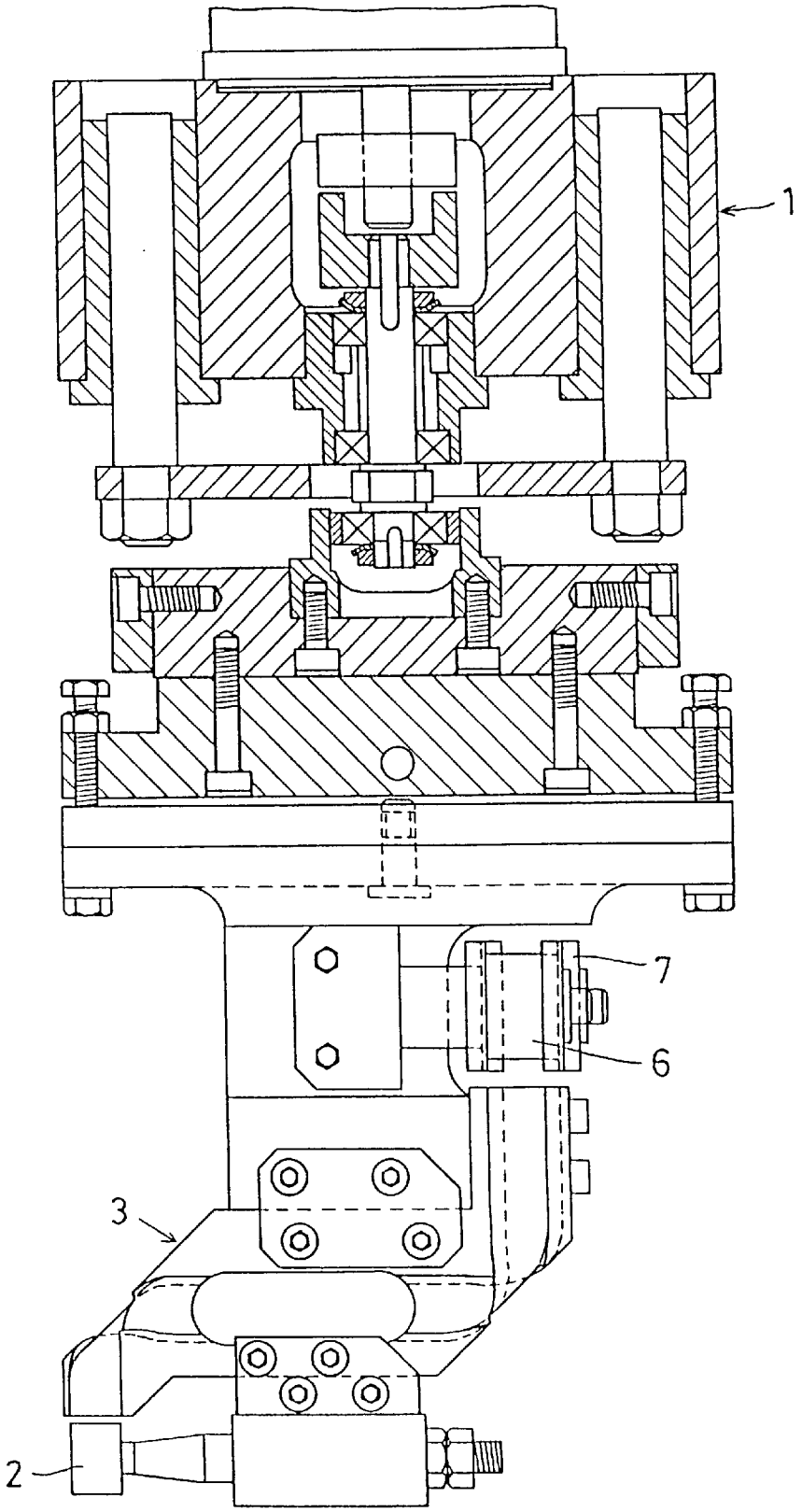
FIG. 1 is a front view showing a superfinishing apparatus of the present invention.

An embodiment of the present invention is described below with reference to the accompanying drawings. Throughout the following description, the same components and parts as in the prior art example are designated by the same reference numerals.

FIG. 1 is a front view showing a superfinishing apparatus using film abrasive according to the present invention. Below an apparatus body 1, the apparatus comprises a backup roll 2 rotatably supported on a shaft which is parallel to the widthwise direction of the body 1. Also, a guide member 3 is secured by bolts or the like above the backup roll. The backup roll 2 is secured to the body 1 together with the guide member 3 through vibratory equipment using an eccentric cam that produces vibratory motion parallel to the direction of the shaft.

Figure 2:
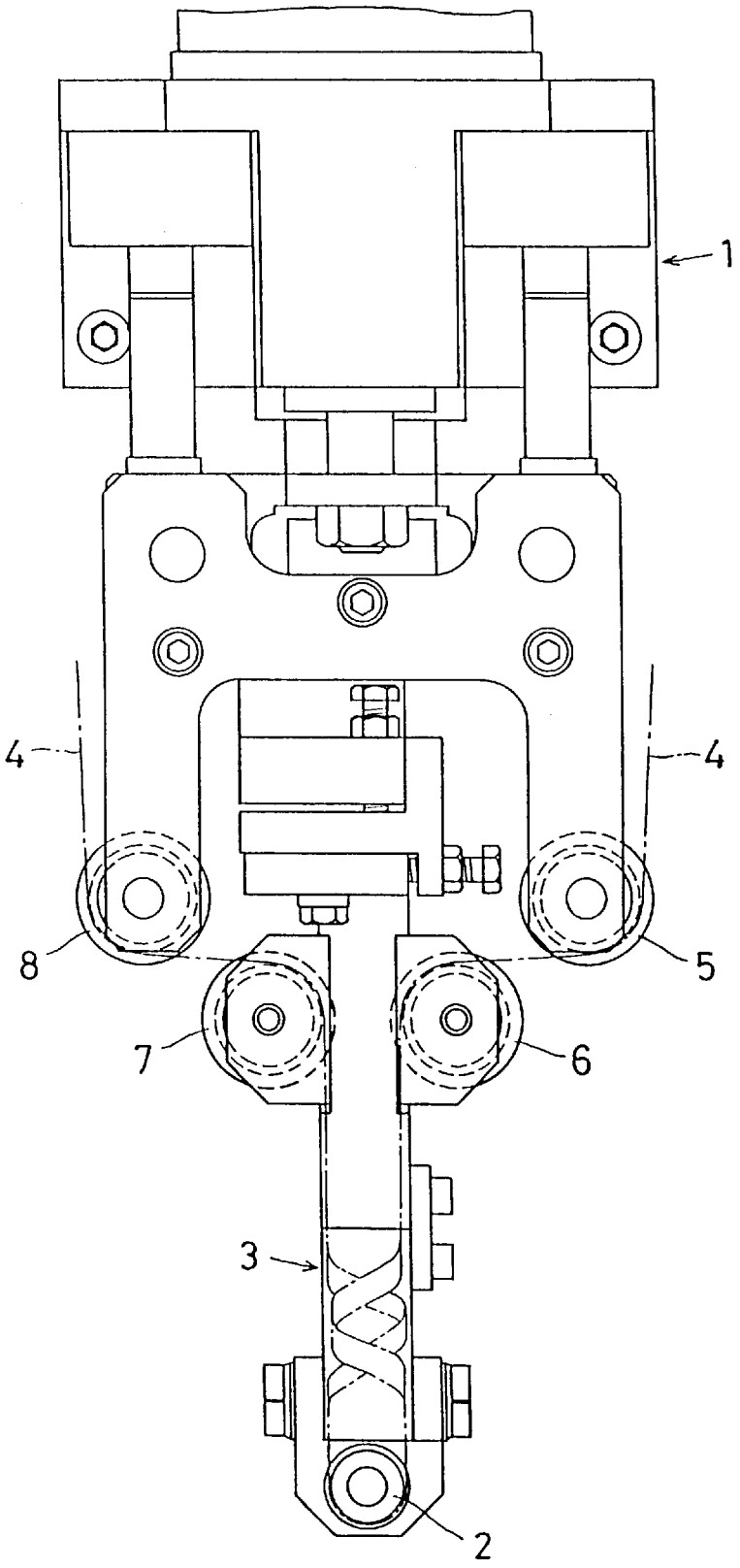
FIG. 2 is a side view showing the superfinishing apparatus of the present invention.

As shown in a side view of FIG. 2, an abrasive film 4 is led to the backup roll 2 from the film-feed side (not shown) via guide rolls 5, 6 and the guide member 3. Further, after being reversed in direction by the backup roll 2, the abrasive film 4 is wound up around a wind-up spool (not shown) through the guide member 3 and guide rolls 7, 8.

Figure 3A:
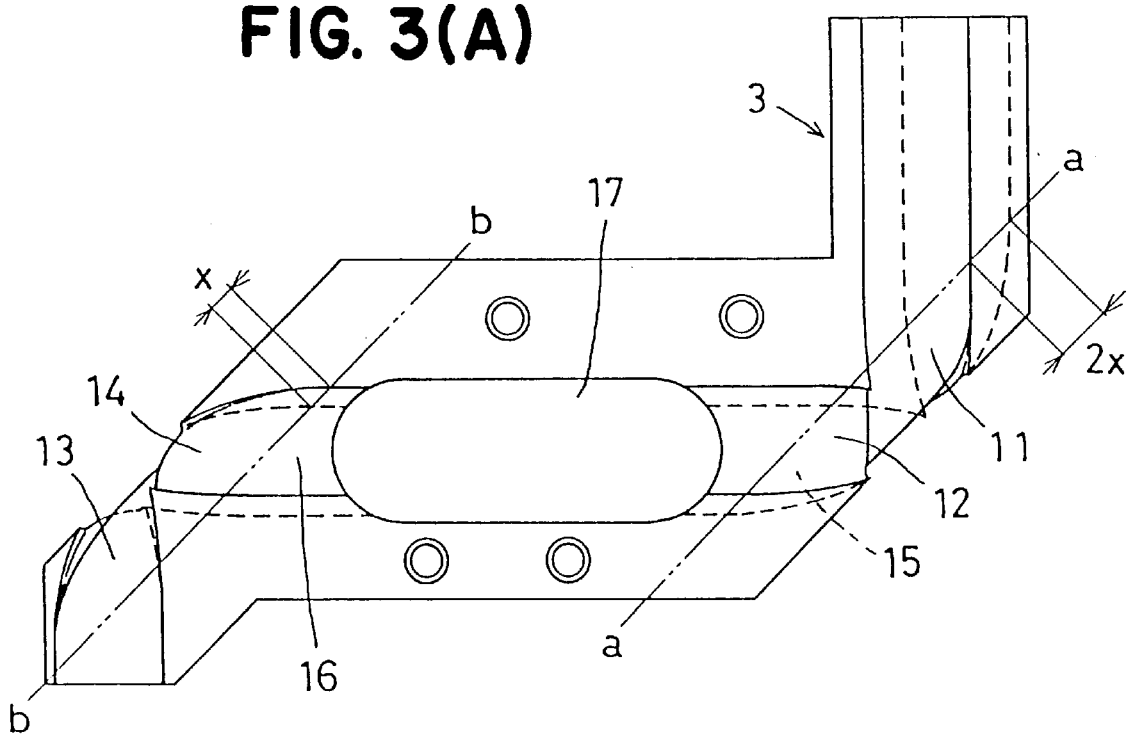
FIGS. 3(A)–3(B) show a guide member of the superfinishing apparatus of the present invention, where
Figure 3B:
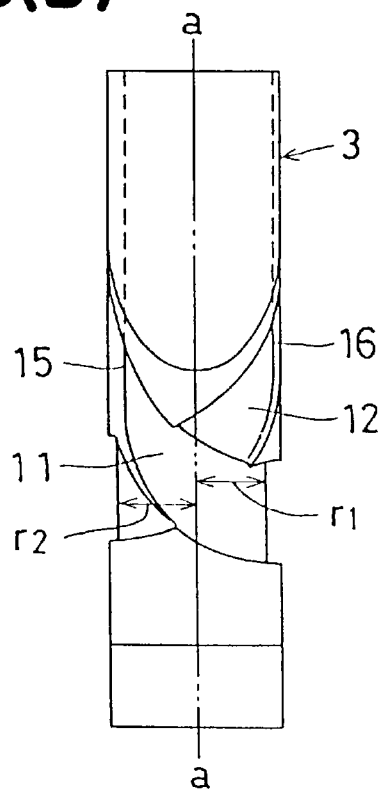
Figure 4A:
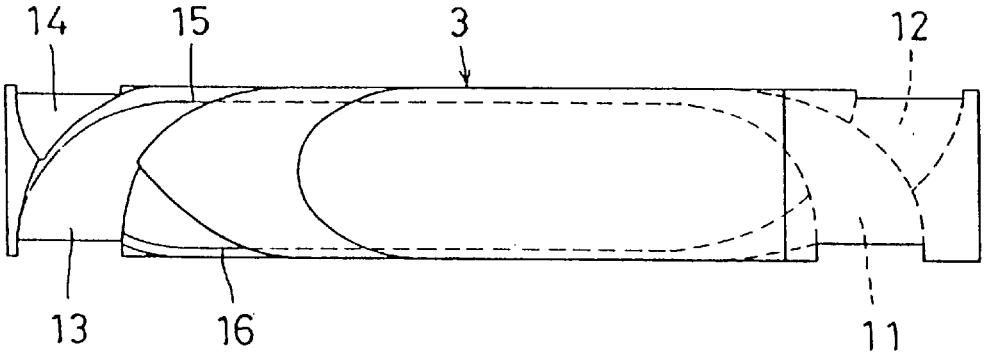
FIGS. 4A–4C show the guide member of the superfinishing apparatus of the present invention, where
Figure 4B:
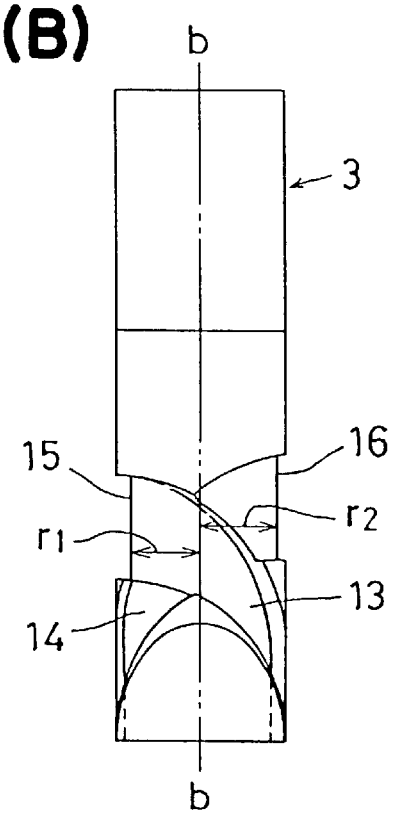
Figure 4C:
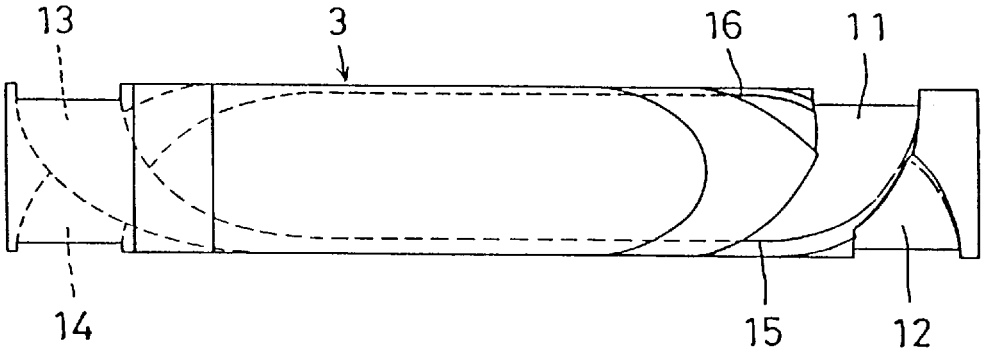

FIGS. 3 and 4 show the guide member 3, where FIG. 3(A) is a front view, FIG. 3(B) is a right side view, FIG. 4(A) is a plan view, FIG. 4(B) is a left side view and FIG. 4(C) is a bottom view.

The guide member 3 is made from a hard material such as iron or other metals or mechanical plastics, and both of its side faces are formed into a semicircular shape in cross section, so as to form part cylindrical portions. Axis a and axis b of the cylindrical portions are angled at 45° with respect to a direction that is vertical to the axis of the backup roll 2, and the axes a, b of both side faces are parallel to each other.

In the cylindrical portions of both side faces of the guide member 3, two helical grooves are provided along helices which are coaxial with the cylindrical portions by a cutting process. Helical grooves 11, 12 are provided in one side face, while helical grooves 13, 14 are provided in the other side face.

The helices are coaxial with respect to the axes a, b of the cylindrical portions of the side faces, and each helical groove is inclined at an angle of 45° with respect to these axes.

The helical grooves 11, 12, 13, 14 each has a groove width which is generally equal to or slightly larger than the width of the abrasive film 4 in order to allow the film 4 to travel therethrough. Also, each groove has a flat bottom surface that allows the film 4 to pass smoothly thereon.

The two helical grooves 13, 14 provided on the backup roll side of the other side face are provided so as to be turned 180° along the cylindrical portion, starting in a direction vertical to the axis of the backup roll 2 and ranging up to a direction parallel to the axis. The two helical grooves 13, 14 are opposite in turning direction with respect to each other, with start portions of the two helical grooves 13, 14 being symmetrical with each other at portions just before the backup roll 2.

The two helical grooves 13, 14 are different in depth, where the difference between their groove depths is the difference in the distance (radius) of the bottom surfaces of the grooves from the center axis b of the helices. The distance of the helical groove 13 from the center axis b is denoted by $r_1$ and the distance of the helical groove 14 from the center axis b is denoted by $r_2$ where $r_1<r_2$.

Due to this difference of radius, a portion where the two helical grooves of different turning directions cross each other is formed into a configuration such as the helical groove 13, which is a deep groove smaller in radius from the center, and disrupts halfway the helical groove 14, which is a shallow groove larger in radius.

Also, terminal points of the helical grooves 13, 14, which are to be machined by referencing the backup roll 2 side, are shifted by x in terms of the distance on the axes of the helices, due to the difference in the radius of the helices.

Referring to the guide member 3, a linear groove 15 which connects with the helical groove 13 is provided on the rear surface, and a linear groove 16 which connects with the helical groove 14 is provided in the front surface in a direction parallel to the axis of the backup roll 2. These linear grooves connect with the helical grooves 11, 12 formed on one side face of the guide member 3, respectively.

In addition, in order to reduce the weight of the guide member 3, the linear grooves 15, 16 are interrupted halfway by a through hole 17 provided in the center of the guide member 3. The through hole has no effect on the feeding of the film.

The helical grooves 11 and 12 are opposite in turning direction to each other, as in the case of the helical grooves 13, 14 on the other side face of the guide member 3. The radii of grooves 11 and 12 from the axis a to the bottom surface of the grooves are $r_1$ for helical groove 11 and $r_2$ for helical groove 12.

Like the helical grooves 13, 14, the helical groove 11, which is a deep groove, i.e. smaller in radius, disrupts halfway the helical groove 12, which is a shallow groove, i.e. larger in radius.

Similarly, at terminal points of the helical grooves 11, 12 whose machining-process base points are shifted by a distance x on the axes of the helices, they are shifted by a distance 2x on the axes of the helices. Thus, if the lead angle is 45°, the traveling path of the abrasive film is shifted transversely by a distance $x\sqrt{2}$ on the feeding and winding-up side of the film 4.

Figure 5:
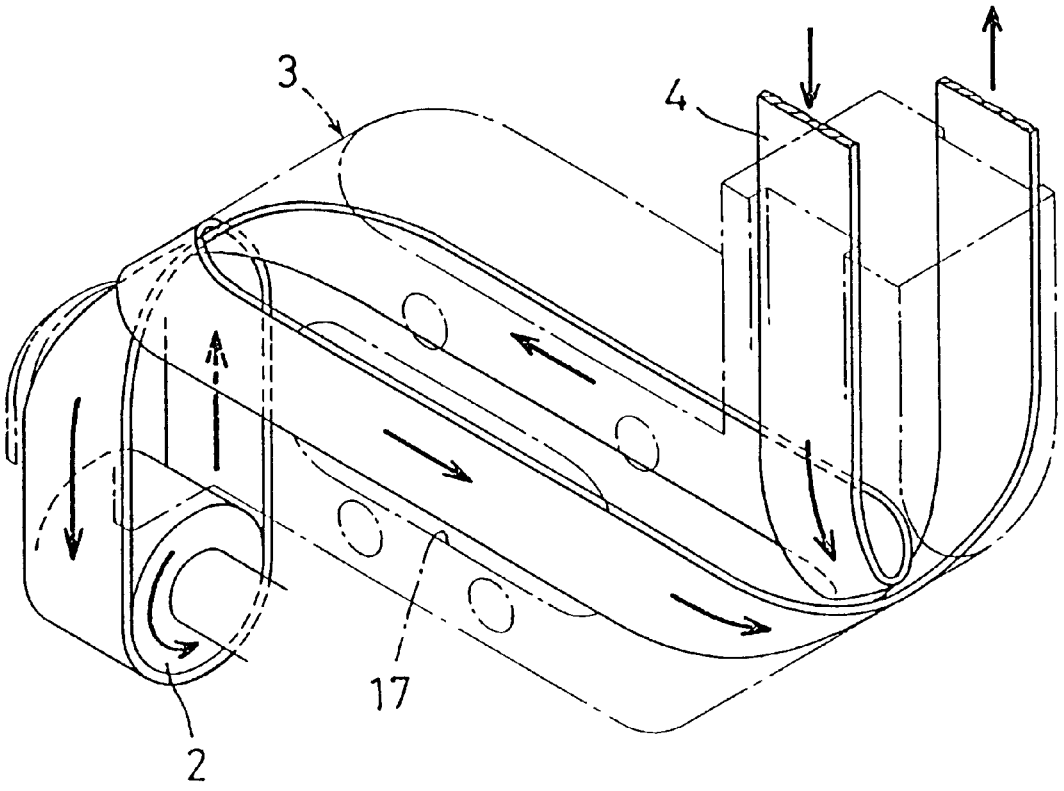
FIG. 5 is a perspective view showing a state in which the film abrasive passes through the guide member.

Next, how the film 4 is fed and wound up in the superfinishing apparatus of the present invention is explained. FIG. 5 shows a traveling image of the film 4 which passes the portions of the guide member 3 and the backup roll 2.

As shown in FIG. 2, the film 4 that has been led out from the feed spool, located in the rear of the apparatus body 1, is led to the guide member 3 via the guide rolls 5, 6 on a one-side face side of the body 1, and led to the helical groove 11 on the one side face of the guide member 3, as shown in FIGS. 3 and 4, so as to be wound around the guide member 3 at an angle of 180°, with the traveling direction being turned perpendicular to the original direction.

The film 4 that has been changed in the traveling direction is led to the linear groove 15 formed on the guide member 3 in continuity with the helical groove 11, and is thereby led to the other side face of the guide member 3.

The film 4 advances along the helical groove 13, which is in continuity to the linear groove 15 on the other side face of the guide member 3, and is wound 180° around the helical groove, and further changed 90° in its advancing or traveling direction, and thus travels in the original direction as that prior to the film 4 entering the guide member 3. Immediately after this, the film 4 is led to the backup roll 2.

The film 4, while keeping its rear surface in contact with the backup roll 2, has its front surface placed into contact with an article or workpiece to be ground. In this state the film 4 is moved in the feeding direction while the backup roll 2 together with the guide member 3 is axially vibrated. Thus, the article or workpiece is superfinished.

The traveling direction of the film 4, that has passed over the workpiece, changes to the opposite direction by the backup roll 2, and is smoothly led to the helical groove 14 of the guide member 3. Then the film is wound 180° around with its rear surface in sliding contact with the helical groove 14.

In this case, along the helical groove 14, in a portion where the helical groove 14 is disrupted by the helical groove 13, the film 4 passes above the film abrasive 4 that passes on the helical groove 13, so that the film crosses in two levels.

The film is changed 90° in its traveling direction by the helical groove 14, and then is led to the linear groove 16, which is in continuity to the helical groove 14. The film abrasive is then fed to one side face of the guide member 3 so as to be wound 180° around the guide member 3 by the helical groove 12 that connects with the linear groove 16. The film abrasive crosses in two levels with the film 4 that passes in the helical groove 11, with the traveling direction changed further by 90°. Thus, the film comes to travel in a direction opposite to the original film-feed direction.

The film 4, which has been fed out from the one side-face side of the guide member 3, is led to the guide rolls 7, 8 and is then accommodated in the wind-up spool.

Figure 6A:
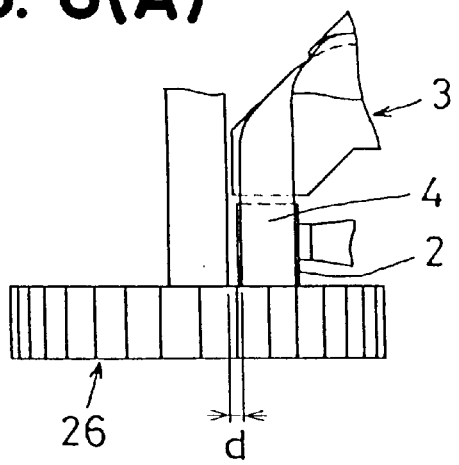
FIGS. 6(A)–6(C) are front views showing a state in which a grinding process by the superfinishing apparatus of the present invention is performed.
Figure 6B:
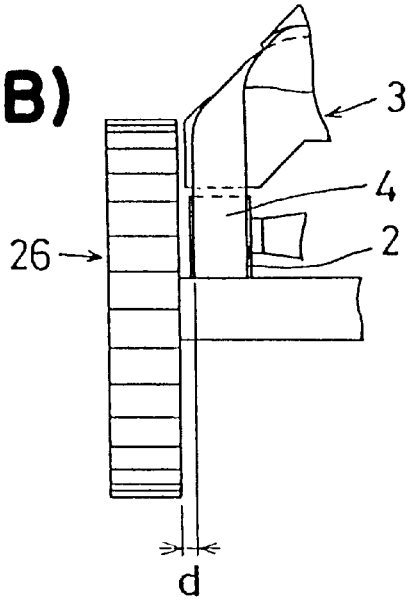
Figure 6C:
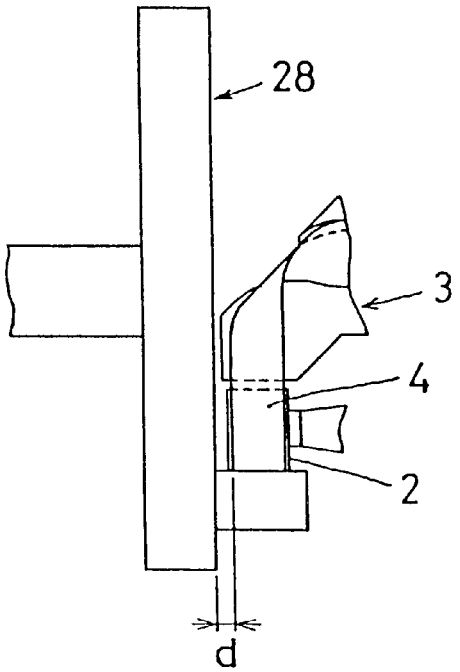
Figure 7:
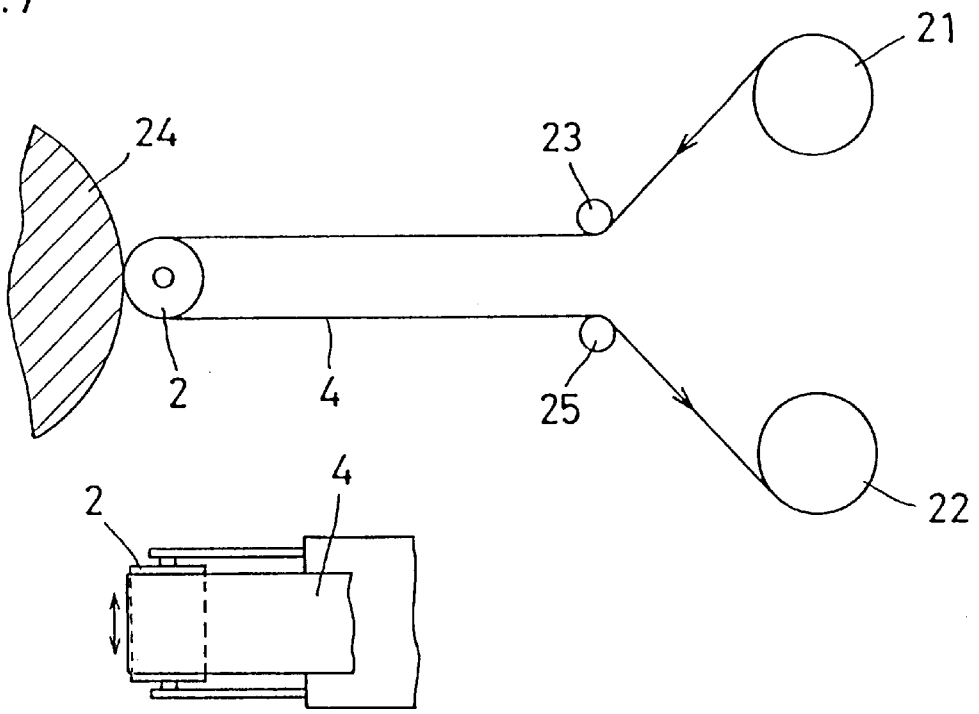
FIG. 7 is a front view showing grinding work with a conventional superfinishing apparatus.
Figure 9:
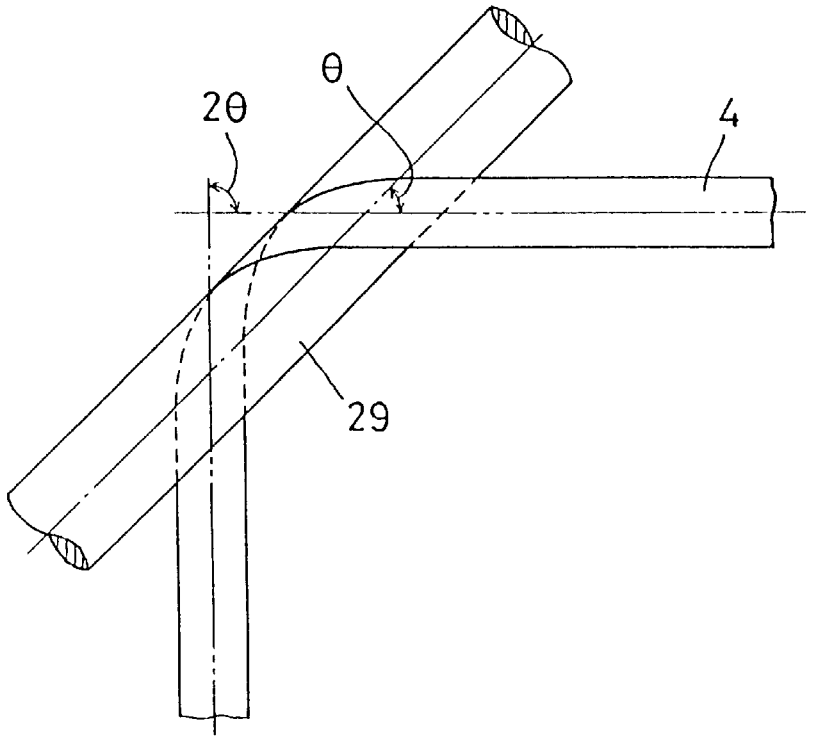
FIG. 9 is a view showing the principle of changing the traveling direction of the film abrasive.
Figure 8A:
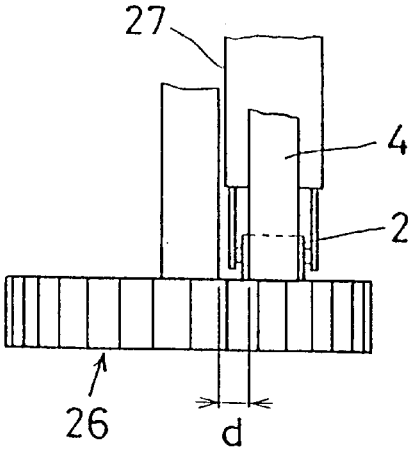
FIGS. 8(A)–8(C) show a state in which a grinding process is performed by using the conventional superfinishing apparatus, where FIGS. 8(A), (B) are front views in which a T-shaped gear is ground
Figure 8B:
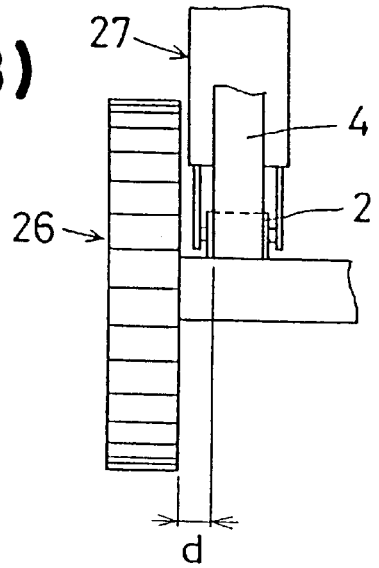
Figure 8C:
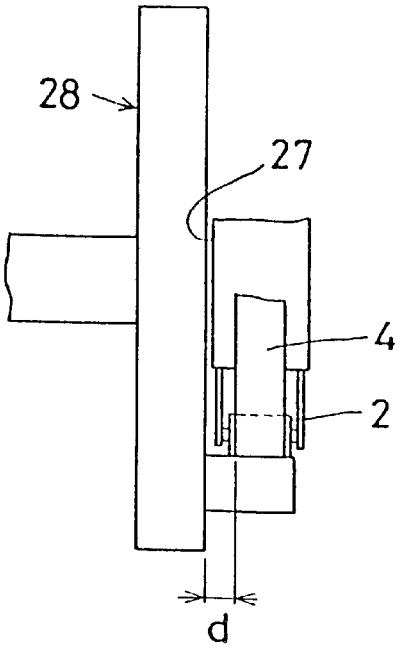

FIG. 6 shows a state of the superfinishing process using the superfinishing apparatus of the present invention. In this case, the film feed mechanism will not make contact with the article being ground, which would occur in the case of FIGS. 8(A), (B), (C) with the conventional superfinishing apparatus for grinding the same part. Thus, the superfinishing apparatus of the present invention is able to superfinish the article up to its small or fine portions with the less distance d of non-ground portions in relation to the conventional case.

The above embodiment of the present invention has been described in a case in which the angle (lead angle) formed by the center axes of the helices of the helical grooves of the guide member and the original film-traveling direction is 45°. However, only if the traveling mechanism for the film can be arranged so as not to protrude on one end side of the backup roll, the lead angle is not limited to 45°, nor is the shift amount particularly specified.

Also, since a plurality of helical grooves that guide the film are provided in the same guide member, the film will travel smoothly without any blocking of the film feed even if a tracking pressure is applied during the film travel. With a small width of the film, for example, 4 mm to 3.5 mm, it was demonstrated that the film can travel without substantially departing from the guide.

As shown above, according to the present invention, the abrasive film, which is fed to and rewound from the backup roll, is kept changed in its traveling direction by the guide member until the time immediately before it is fed to the backup roll, so that no protrusions due to the film or its feed mechanism are protruded on one end side of the backup roll. Thus, the apparatus of the present invention is able to perform superfinishing on parts configured such that it would conventionally be impossible to superfinish because of the interference of these protrusions.

Moreover, the direction of grinding performed on the article and the direction of film feed are the same as in conventional superfinishing apparatuses. Therefore, there is another advantage in that it is necessary to prepare only one guide member just before the backup roll, which allows most of the component parts of superfinishing apparatuses having a conventional feed mechanism as well as the existing working equipment to be used as they are.

What is claimed is:

1. A superfinishing apparatus comprising:

an apparatus body;

a guide member connected to said apparatus body, said guide member comprising a first side face, and a second side face;

a first helical groove formed in said first side face of said guide member;

a second helical groove formed in said first side face of said guide member and extending in an opposite direction relative to said first helical groove, wherein said first and second helical grooves have a common central axis, and a distance from the central axis to a bottom surface of said first groove is greater than a distance from the central axis to a bottom surface of said second groove;

a third helical groove formed in said second side face of said guide member;

a fourth helical groove formed in said second side face of said guide member and extending in an opposite direction relative to said third helical groove, wherein said third and fourth helical grooves have a common central axis, and a distance from the central axis of said third and fourth helical grooves to a bottom surface of said third helical groove is greater than a distance from the central axis of said third and fourth helical grooves to a bottom surface of said fourth helical groove;

a backup roll for pressing and vibrating an abrasive film against a workpiece, said backup roll being rotatably supported on a shaft which is disposed adjacent to said guide member; and a film feed mechanism for feeding the abrasive film to said guide member and for feeding the abrasive film to a wind-up spool from said guide member.

2. A superfinishing apparatus as claimed in claim 1, wherein each of said first, second, third and fourth helical grooves, formed in said first and second side surfaces of said guide member, extend through an angle of 180°.

3. A superfinishing apparatus as claimed in claim 1, further comprising:

a first linear groove formed in said guide member, said first linear groove communicating with said first and third helical grooves; and a second linear groove formed in said guide member, said second linear groove communicating with said second and fourth helical grooves.

4. A guide member for guiding an abrasive film in a superfinishing apparatus, said guide member comprising:

a guide body having a first side face and a second side face;

a first helical groove formed in said first side face of said guide body;

a second helical groove formed in said first side face of said guide body and extending in an opposite direction relative to said first helical groove, wherein said first and second helical grooves have a common central axis, and the depth of said first helical groove is greater than a depth of said second groove;

a third helical groove formed in said second side face of said guide body; and a fourth helical groove formed in said second side face of said guide body and extending in an opposite direction relative to said third helical groove, wherein said third and fourth helical grooves have a common central axis, and a depth of said third helical groove is greater than a depth of said fourth helical groove.

5. A guide member as claimed in claim 4, wherein each of said first, second, third and fourth helical grooves, formed in said first and second side surfaces of said guide member, extend through an angle of 180°.

6. A guide member as claimed in claim 4, further comprising:

a first linear groove formed in said guide member body, said first linear groove communicating with said first and third helical grooves; and a second linear groove formed in said guide member body, said second linear groove communicating with said second and fourth helical grooves.

* * * * *